US009592924B2

(12) United States Patent
Decio

(10) Patent No.: US 9,592,924 B2
(45) Date of Patent: Mar. 14, 2017

(54) ASEPTIC FILLING MACHINE

(71) Applicant: ALFA LAVAL CORPORATE AB, Lund (SE)

(72) Inventor: Pierluigi Decio, Milan (IT)

(73) Assignee: ALFA LAVAL CORPORATE AB, Lund (SE)

( * ) Notice: Subject to any disclaimer, the term of this patent is extended or adjusted under 35 U.S.C. 154(b) by 747 days.

(21) Appl. No.: 13/720,548

(22) Filed: Dec. 19, 2012

(65) Prior Publication Data

US 2013/0160400 A1 Jun. 27, 2013

(30) Foreign Application Priority Data

Dec. 23, 2011 (IT) ..... RE2011A0111

(51) Int. Cl.
*B65B 1/04* (2006.01)
*B65B 39/12* (2006.01)
(Continued)

(52) U.S. Cl.
CPC ..... *B65B 1/04* (2013.01); *B65B 3/045* (2013.01); *B65B 31/022* (2013.01); *B65B 39/12* (2013.01); *B65B 39/145* (2013.01); *B65B 43/16* (2013.01); *B65B 43/40* (2013.01); *B65B 43/465* (2013.01); *B65B 43/50* (2013.01); *B65B 43/60* (2013.01);
(Continued)

(58) Field of Classification Search
CPC B65B 3/04; B65B 39/12; B65B 39/14; B65B 31/02; B65B 55/02; B65B 55/027; B65B 43/40; B65B 43/46; B65B 43/50; B65B 43/60; B65B 43/16; B65B 43/465; B65B 61/28; B65B 31/00; B65B 31/024;
(Continued)

(56) References Cited

U.S. PATENT DOCUMENTS 1,372,480 A 3/1921 Buschman
1,895,824 A * 1/1933 Stenhouse ..... 414/744.6
(Continued)

FOREIGN PATENT DOCUMENTS

CN 2772964 Y 4/2006
CN 1968888 A 5/2007
(Continued)

OTHER PUBLICATIONS

Partial European Search Report issued in European counterpart application No. EP 12 19 7672.

*Primary Examiner* — Hemant M Desai
*Assistant Examiner* — Eduardo R Ferrero
(74) *Attorney, Agent, or Firm* — Birch, Stewart, Kolasch & Birch, LLP

(57) ABSTRACT

An aseptic filling machine of envelope-type bags provided with a filling mouth closed by a removable cap, comprising an empty bag supply device, a discharge device configured to discharge full bags, a carousel device on which at least two filling stations are located; each filling station comprising a sterile chamber; a raising device configured to raise the mouth of the empty bag internally of the sterile chamber; an overpressure device configured to place the chamber in slight overpressure; a removal device configured to remove the cap and positioning it by a side of the mouth; and a dispenser-batcher device that is vertically slidable and configured to engage with the mouth.

13 Claims, 13 Drawing Sheets

(51) Int. Cl.

| | |
|---|---|
| ***B65B 39/14*** | (2006.01) |
| ***B65B 43/16*** | (2006.01) |
| ***B65B 43/40*** | (2006.01) |
| ***B65B 43/46*** | (2006.01) |
| ***B65B 43/50*** | (2006.01) |
| ***B65B 43/60*** | (2006.01) |
| ***B65B 55/02*** | (2006.01) |
| ***B65B 3/04*** | (2006.01) |
| ***B65B 61/28*** | (2006.01) |
| *B65B 31/04* | (2006.01) |
| *B65B 31/06* | (2006.01) |
| *B65B 31/00* | (2006.01) |
| *B65B 31/02* | (2006.01) |
| *B65B 3/17* | (2006.01) |

(52) U.S. Cl.

CPC ..... *B65B 55/022* (2013.01); *B65B 55/027* (2013.01); *B65B 61/28* (2013.01); *B65B 3/17* (2013.01); *B65B 31/00* (2013.01); *B65B 31/02* (2013.01); *B65B 31/024* (2013.01); *B65B 31/044* (2013.01); *B65B 31/048* (2013.01); *B65B 31/06* (2013.01)

(58) Field of Classification Search

CPC ..... B65B 31/04; B65B 31/044; B65B 31/048; B65B 31/06; B66F 7/22

USPC ..... 53/281, 284.7, 268, 329.2, 301, 381.4, 53/468; 141/85; 414/753.1, 621, 794.2; 81/3.08, 3.27, 3.2

See application file for complete search history.

(56) References Cited

U.S. PATENT DOCUMENTS

| | | | | |
|---|---|---|---|---|
| 3,888,362 | A * | 6/1975 | Fletcher et al. | 414/620 |
| 4,120,134 | A * | 10/1978 | Scholle | B65B 43/54 141/114 |
| 4,283,901 | A * | 8/1981 | Schieser et al. | 53/75 |
| 4,291,909 | A * | 9/1981 | Coatantiec | 294/198 |
| 4,452,030 | A * | 6/1984 | Inada | B65B 55/022 141/10 |
| 4,481,753 | A * | 11/1984 | Rutter | B65B 7/2807 141/10 |
| 4,494,363 | A * | 1/1985 | Rica et al. | 53/426 |
| 4,498,508 | A * | 2/1985 | Scholle et al. | 141/5 |
| 4,519,184 | A * | 5/1985 | Brunswick | 53/503 |
| 4,574,559 | A * | 3/1986 | Rutter et al. | 53/282 |
| 4,676,285 | A * | 6/1987 | Schieser et al. | 141/114 |
| 4,750,311 | A * | 6/1988 | Catelli | 53/281 |
| 4,805,378 | A | 2/1989 | Anderson | |
| 4,843,797 | A * | 7/1989 | Butterly et al. | 53/448 |
| 4,984,677 | A * | 1/1991 | Prakken | 198/418.6 |
| 4,999,978 | A * | 3/1991 | Kohlbach et al. | 53/512 |
| 5,029,432 | A * | 7/1991 | Loeliger | B29C 65/18 156/282 |
| 5,090,180 | A * | 2/1992 | Sorensen | 53/471 |
| 5,129,212 | A * | 7/1992 | Duffey et al. | 53/426 |
| 5,237,797 | A * | 8/1993 | Varlet | 53/420 |
| 5,400,837 | A * | 3/1995 | Kelley et al. | 141/10 |
| 5,544,828 | A * | 8/1996 | Winkler et al. | 242/473.5 |
| 5,551,833 | A * | 9/1996 | Marsh | 414/793.4 |
| 5,580,599 | A * | 12/1996 | Fehr | 426/499 |
| 5,860,461 | A * | 1/1999 | Helmut | 141/326 |
| 5,975,163 | A * | 11/1999 | Gianfranco | 141/313 |
| 5,975,605 | A * | 11/1999 | Kot | 294/115 |
| 6,148,874 | A * | 11/2000 | Rutter | B65B 39/004 141/10 |
| 6,286,568 | B1 * | 9/2001 | Araki et al. | 141/166 |
| 6,302,172 | B1 * | 10/2001 | De Villele | 141/372 |
| 6,305,437 | B1 * | 10/2001 | Edwards et al. | 141/1 |
| 6,330,780 | B1 * | 12/2001 | Shipway | 53/426 |
| 6,604,560 | B2 * | 8/2003 | Ikemoto et al. | 141/147 |
| 6,796,342 | B2 * | 9/2004 | De Antoni Migliorati et al. | 141/165 |
| 6,889,482 | B2 * | 5/2005 | Edwards et al. | 53/384.1 |
| 6,959,953 | B2 * | 11/2005 | Graffin | 294/104 |
| 7,159,489 | B2 * | 1/2007 | Itoh | 81/3.2 |
| 7,373,959 | B2 * | 5/2008 | Edwards | B65B 3/045 141/10 |
| 7,533,512 | B2 * | 5/2009 | Levati et al. | 53/167 |
| 7,748,518 | B2 * | 7/2010 | Hollriegl et al. | 198/470.1 |
| 8,201,594 | B2 * | 6/2012 | Martin | 141/193 |
| 2002/0017075 | A1 * | 2/2002 | Resterhouse et al. | 53/287 |
| 2002/0066260 | A1 * | 6/2002 | Hiramoto et al. | 53/571 |
| 2003/0182901 | A1 * | 10/2003 | Savage et al. | 53/468 |
| 2006/0086065 | A1 * | 4/2006 | Tomalesky et al. | 53/425 |
| 2007/0119121 | A1 * | 5/2007 | Woods et al. | 53/268 |
| 2007/0137727 | A1 * | 6/2007 | Stricklin | 141/114 |
| 2007/0204570 | A1 * | 9/2007 | Okazaki | 53/459 |
| 2007/0237672 | A1 | 10/2007 | Colato et al. | |
| 2007/0261369 | A1 * | 11/2007 | Takahara et al. | 53/317 |
| 2009/0056281 | A1 * | 3/2009 | Murray | 53/455 |
| 2009/0127258 | A1 * | 5/2009 | Gates | 220/200 |
| 2009/0308031 | A1 * | 12/2009 | Koga et al. | 53/570 |
| 2010/0180550 | A1 * | 7/2010 | Yamamoto et al. | 53/459 |
| 2010/0192524 | A1 * | 8/2010 | Rapparini | 53/512 |
| 2010/0266372 | A1 * | 10/2010 | Freed | 414/225.01 |
| 2010/0281822 | A1 * | 11/2010 | Murray | 53/64 |

FOREIGN PATENT DOCUMENTS

| | | | |
|---|---|---|---|
| EP | 0 072 699 | A | 2/1983 |
| EP | 1 067 052 | A1 | 1/2001 |
| GB | 2 058 729 | A | 4/1981 |
| WO | 03022314 | A2 | 3/2003 |
| WO | 03024800 | A2 | 3/2003 |
| WO | WO 03022314 | * | 3/2003 |

* cited by examiner

ASEPTIC FILLING MACHINE

INCORPORATION BY REFERENCE

The following documents are incorporated herein by reference as if fully set forth: Italian Patent Application No. RE2011A000111, filed Dec. 23, 2011.

FIELD OF INVENTION

The present invention relates to filling sterile containers with liquid or semi-dense food products such as for example fruit juices or tomato paste.

BACKGROUND

The containers are constituted by bags of synthetic material, having a rectangular or square shape, constituted by two sheets welded along the edges thereof.

One of the two sheets comprises, in proximity of one of the smaller sides, preferably on the longitudinal axis of the bag, a filling mouth closed by a removable cap.

In the following the terms container and bag will be used interchangeably.

The containers are filled in linear machines comprising, in addition to a bag advancement line, a sterile chamber, preferably parallelepiped but also possibly cylindrical, in which the mouth is housed in the bottom, through an opening in the lower wall of the chamber.

The sterile chamber comprises means for supporting the mouth in the chamber and returning it to the advancement line, means for spraying a liquid disinfectant in the vicinity of the mouth, means for removing the cap and retaining it in a position by the side of the mouth and replacing it on the mouth, as well as a vertical-axis batcher-dispenser for introducing the product into the bag.

After the bag has been filled, the cap is reapplied to the mouth, the mouth is released to outside the chamber, and the bag is laid on the advancement line.

All the above-described operations are carried out using devices that are in themselves known to the technical expert in the sector, and which will be omitted from the detailed description.

Known linear machines have the disadvantage of a low production capacity due to the difficulty of changing the format of the containers, mouths and removable caps, as well as being due to the time the bag remains in the filling station—the time being the time required for performing all of the above-described operations.

Approximately these operations require a total time of more than about 5 seconds per bag, while the time required only for filling the bag is in the order of a second or a little more, depending on the capacity of the bag.

The purpose of the present invention is to obviate all these problems with a simple and effective solution.

This aim is attained by a filling machine having the characteristics recited in the independent claim; the dependent claims relate to other characteristics of the invention which are intended to provide further advantages.

SUMMARY

In substance, the invention comprises a base on which a rotating circular platform is positioned, which platform is moved in a continuous rotary motion by suitable means.

At least two, and preferably six or more identical filling stations are located on the rotating platform, which stations are equally spaced and individually equipped with a lower rest plane for the bag, with the mouth located vertically.

Present at the periphery of the platform are: a loading apparatus of the empty bag at the first filling station in which the filling cycle begins, and an unloading apparatus of the filled bag from the filling station, located immediately downstream of the first, with reference to the movement direction of the carousel.

The loading apparatus comprises a device for transferring the empty bag from supply means of the bags, by gripping it by the mouth, and for positioning the bag in a suitable position on the rest plane of the first station.

The means for supplying empty bags are known in themselves and generally comprise a supply roll of empty bags, and means for bringing the first bag separated from the roll to the filling station.

Each filling station comprises a support bracket fastened to the platform, to which a rest plane for the bag and an overlying filling group are headed, facing externally of the platform.

Each filling unit comprises a sterile chamber as well as the means for inserting the mouth into the sterile chamber, the disinfection of the area around the mouth, the removal and displacement of the cap to the side of the mouth, insertion of the batcher-dispenser into the mouth—and the reverse operations.

The rest plane of the bag is openable downwards, such as to unload the full bag when the filling station is in the unloading position and drop it onto an underlying conveyor.

BRIEF DESCRIPTION OF THE DRAWINGS

The qualities and constructional features of the invention will become apparent from the functional and detailed description that follows, which with the aid of the attached drawings tables illustrates a preferred embodiment of invention given by way of non-limiting example.

DETAILED DESCRIPTION OF THE PREFERRED EMBODIMENTS

Figure 1:
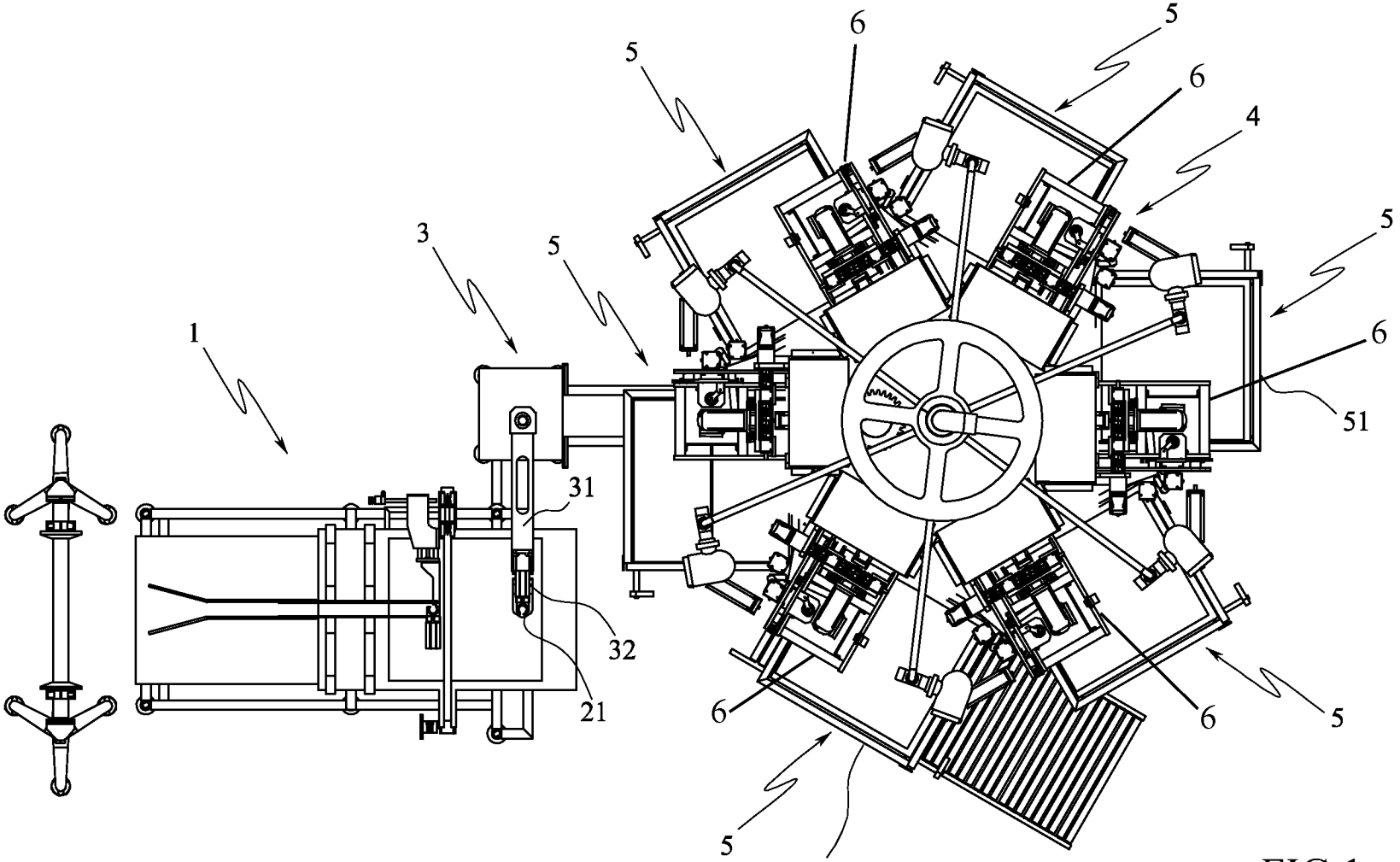
FIG. 1 illustrates the invention in plan view.
Figure 2:
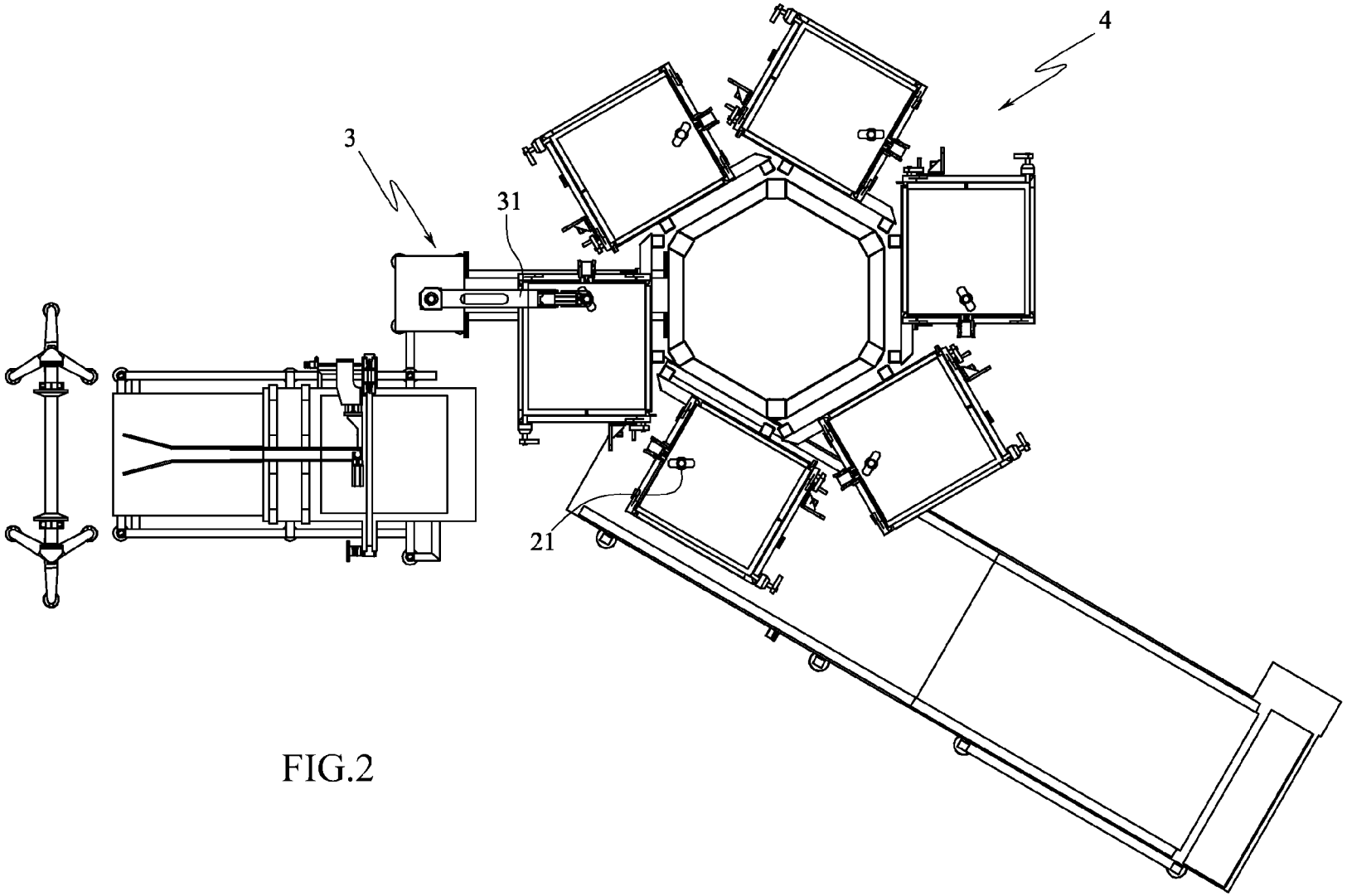
FIG. 2 shows the section of FIG. 1 below the filling groups.
Figure 3:
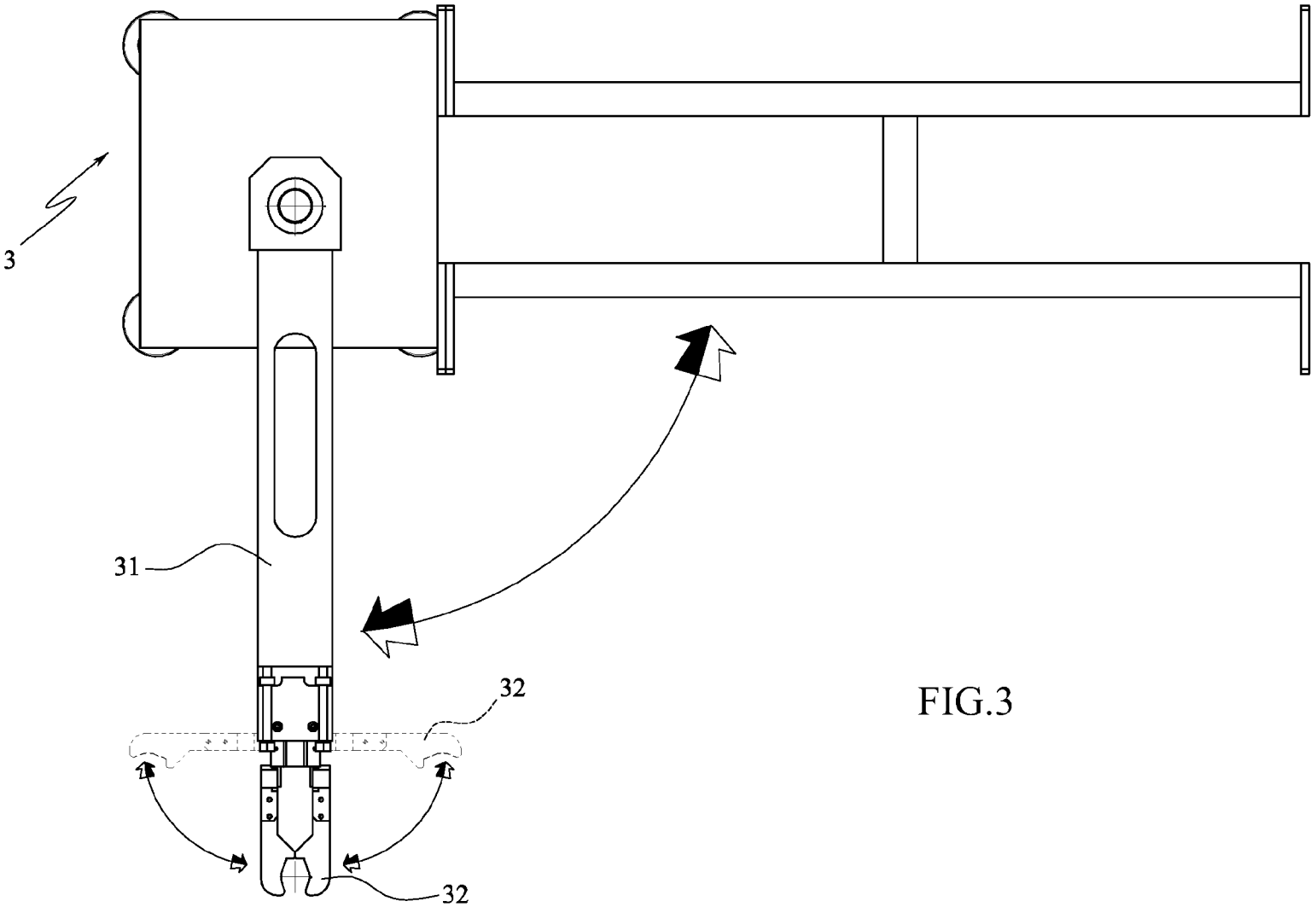
FIG. 3 is a detail of FIG. 2 in larger scale.
Figure 4:
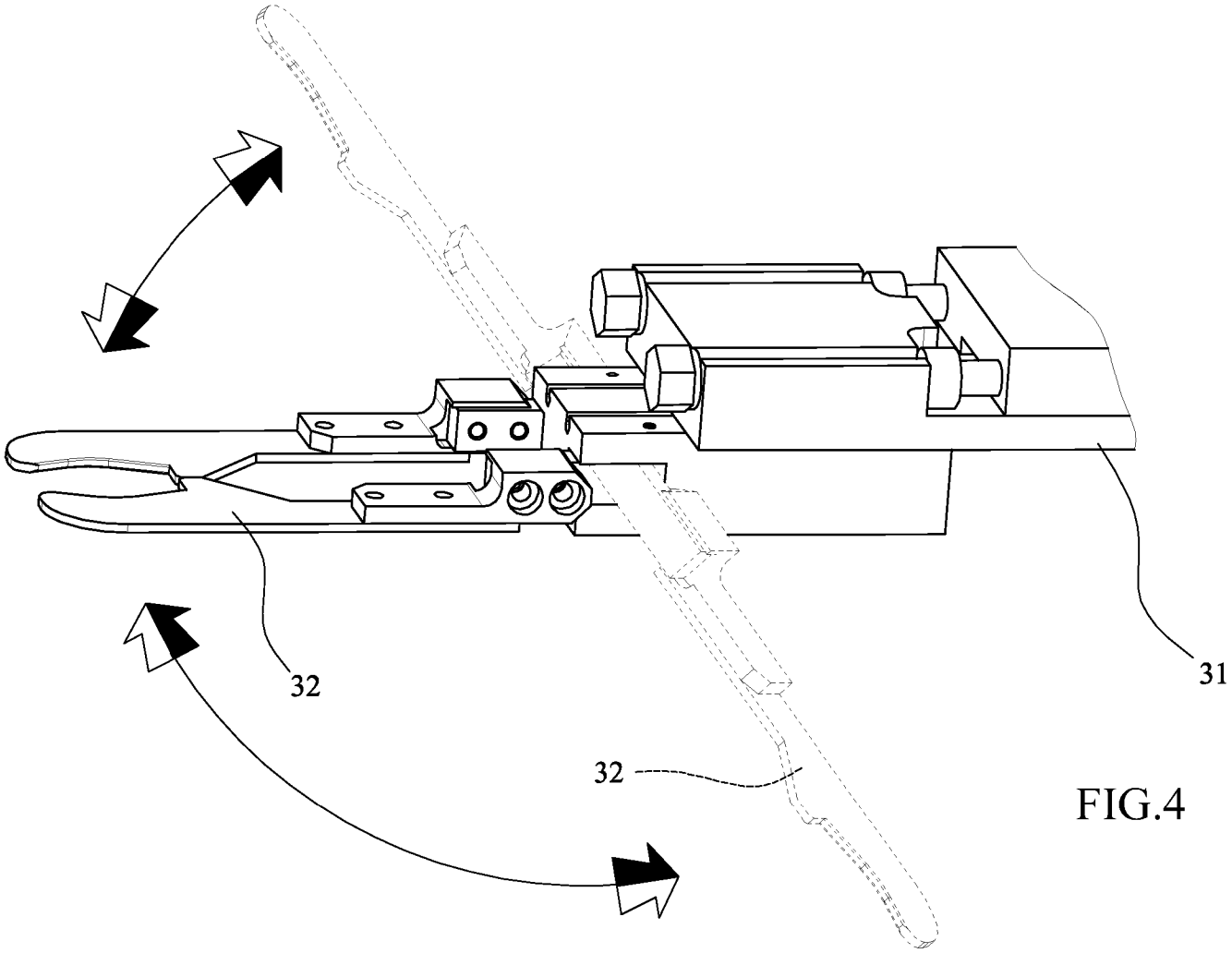
FIG. 4 shows the detail of FIG. 3 in perspective view.

The figures relate to a bag-supplying device 1 with a mouth 21 facing upwards. A positioning device 3 is located by a side of the device 1, comprising an arm 31 provided with pliers 32 at an end, which move between a first position in which the pliers overlie the mouth 21 of the arriving bag, and a second position (FIG. 2) in which the bag is located on the rest plane of the first station.

The pliers 32 are pneumatically activated by means that are not illustrated, and exhibit jaws that are destined to open by 180° such as not to obstruct the releasing of the mouth 21.

The movement of the arm is powered by a brushless stepper motor.

Figure 5:
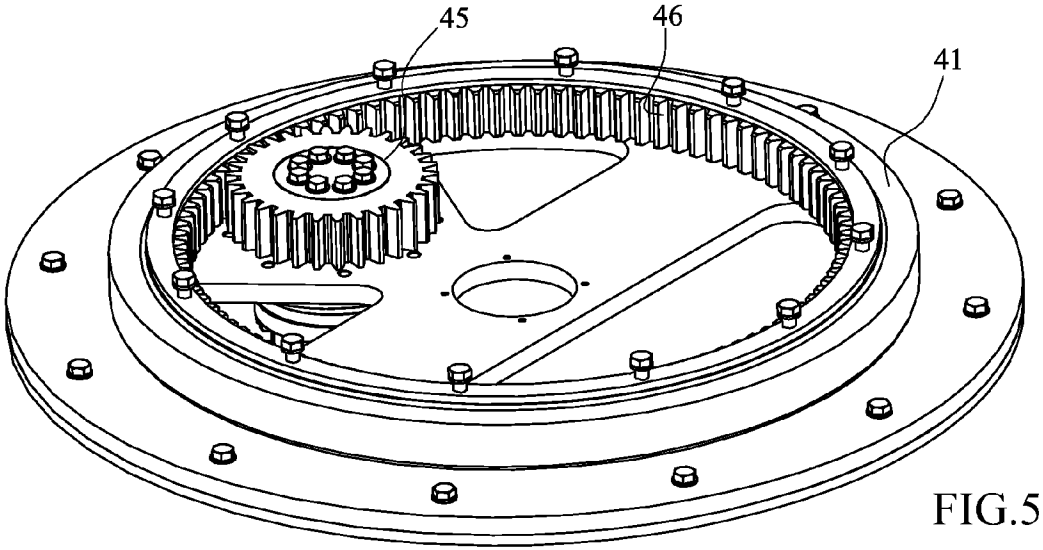
FIG. 5 and FIG. 6 show, in perspective view and in section, the means for activating the rotating platform.

A carousel 4 rotates downstream of the positioning device. The carousel 4 comprises (FIGS. 5, 6) a fifth wheel 41 a fixed ring of which is solidly constrained to the base 42, and the mobile ring of which is fixed to a platform 43.

The platform 43 is moved by an electric motor 44 having an adjustable velocity on the axis of which a pinion 45 is keyed, which enmeshes in a crown wheel 46 solidly constrained to the platform 43.

Six filling stations 5 are fixed in equidistant positions on the platform 43.

Figure 14:
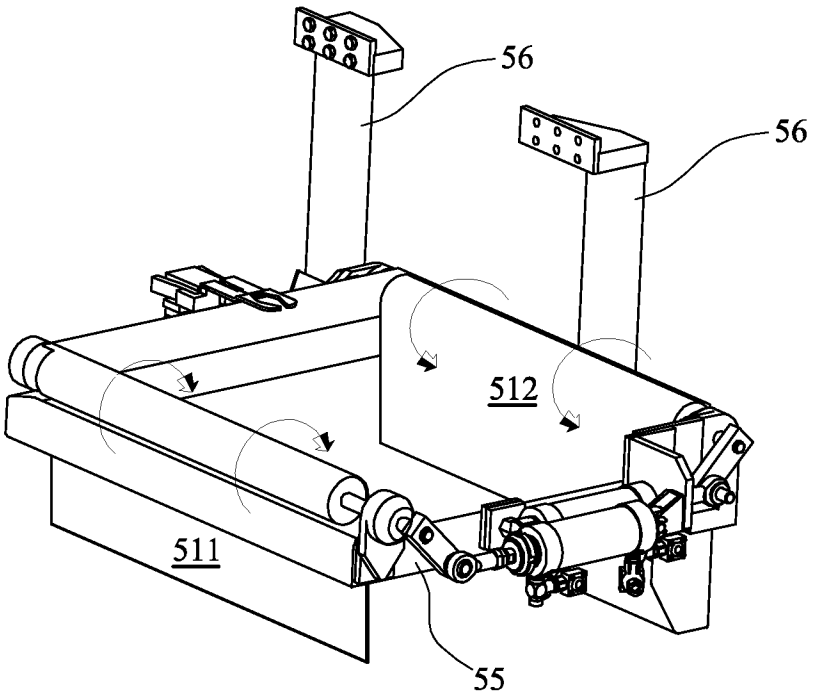
FIG. 13 and FIG. 14 illustrate a perspective view of the rest plane for the bag, in the open and closed position.
Figure 13:
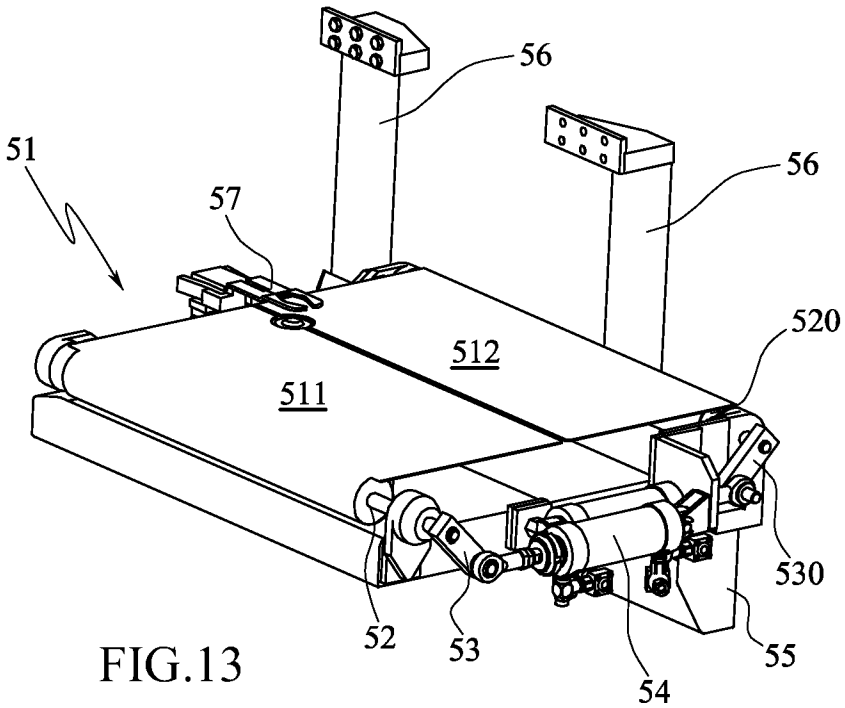

Each filling station comprises a lower rest plane 51 for a bag, constituted by two doors 511 and 512 (FIGS. 13 and 14), which can be arranged (FIG. 13) coplanarly or can rotate symmetrically in a downwards direction (FIG. 14).

Each door is coupled to a roller 52, 520 on the axis of which a crank 53, 530 is keyed, the crank heads to the double stem of a piston cylinder group 54.

Figure 6:
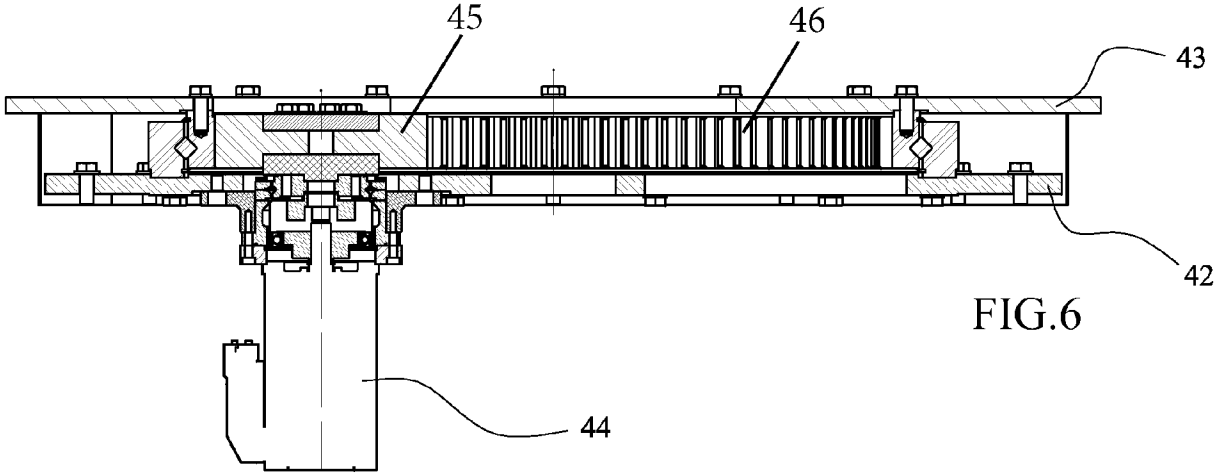
Figure 7:
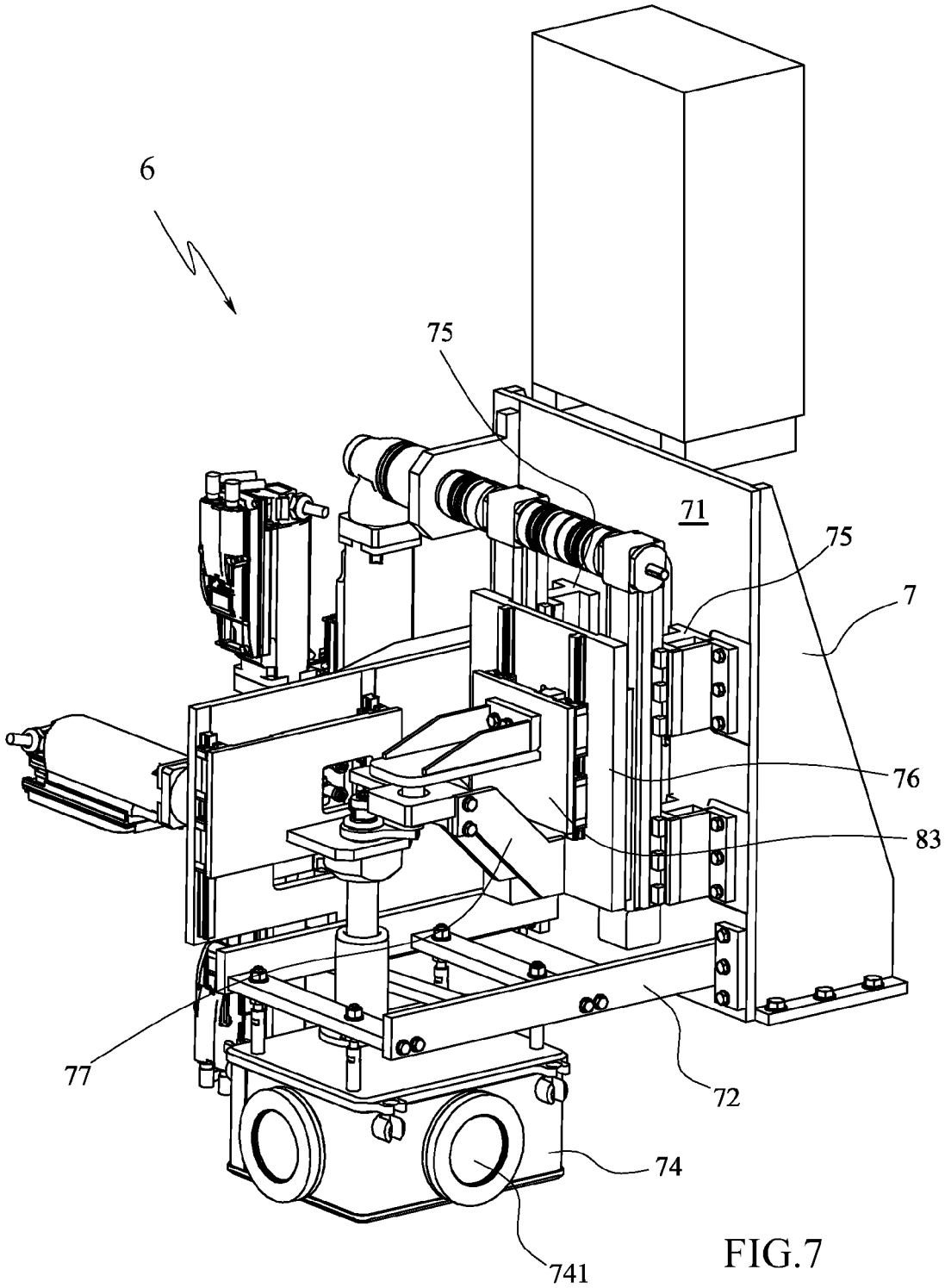
FIG. 7 shows a filling group in a perspective view, with some parts removed.
Figure 8:
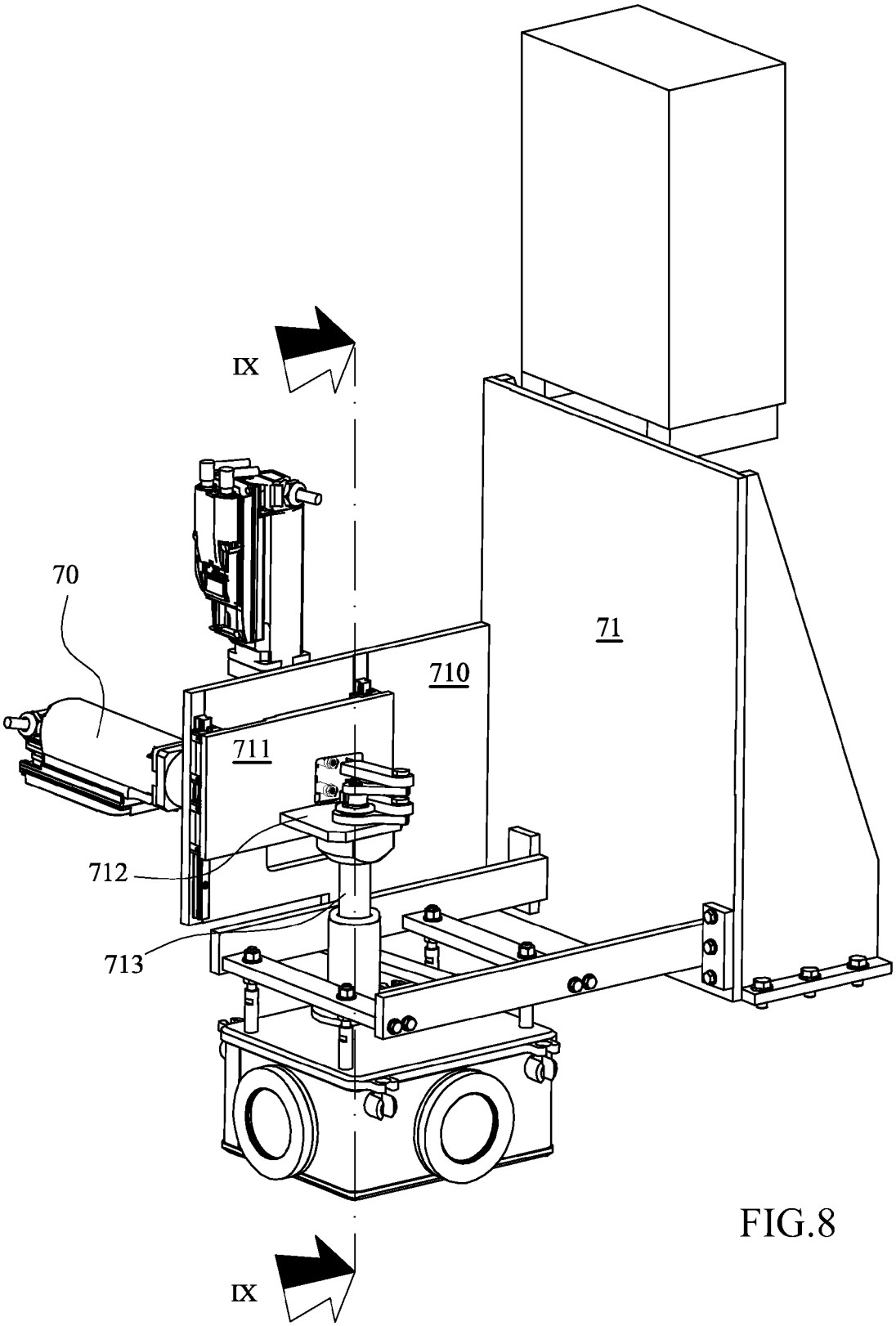
FIG. 8 is the same as FIG. 7, with other parts removed.
Figure 8A:
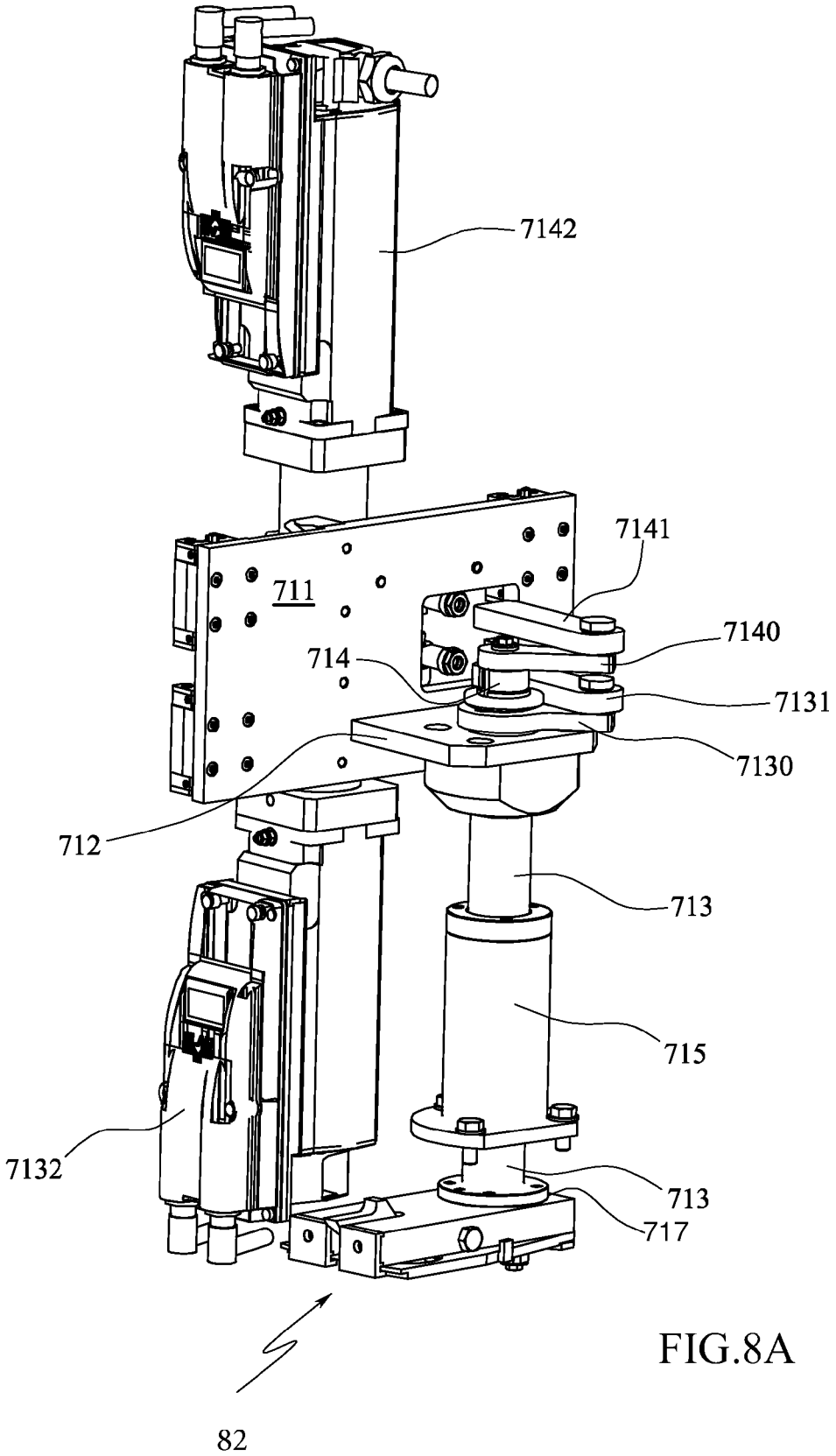
FIG. 8A shows parts of FIG. 8.

The entirety is supported by a frame 55 which is suspended by means of brackets 56 below the rotating platform 43 (FIG. 6).

Pliers 57 are located on a side of the lower rest plane 51 (FIGS. 15, 16), in the line of contact between the planes, at the position occupied by the mouth 21 of the bag, such as to load the mouth after the pliers 32 have brought it into position below the sterile chamber.

The pliers 57 exhibit the same characteristics as the pliers 32.

The pliers 57, activated by the piston cylinder group 58 supported by frame 55, move vertically to place the mouth in the sterile chamber.

Figure 16:
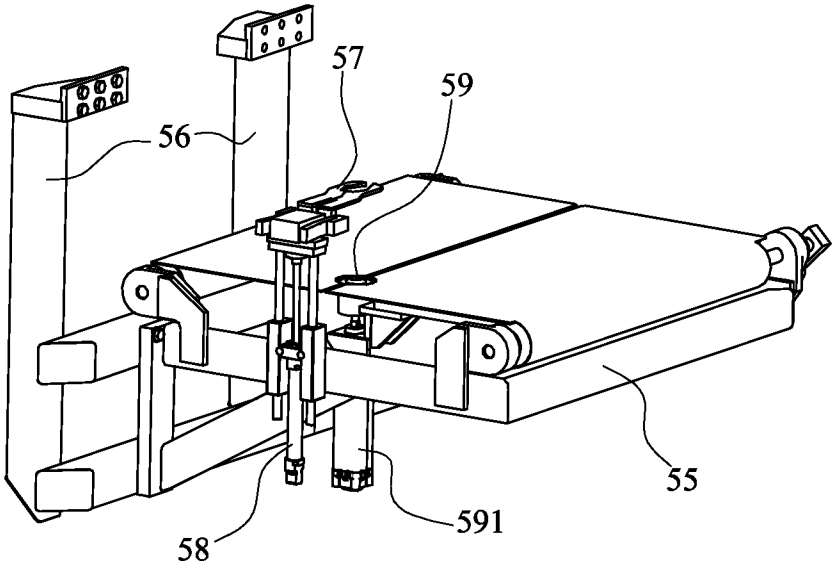
FIG. 15 and FIG. 16 illustrate a different perspective view of the rest plane for the bag, with the mouth raising means in upper and lower positions.
Figure 15:
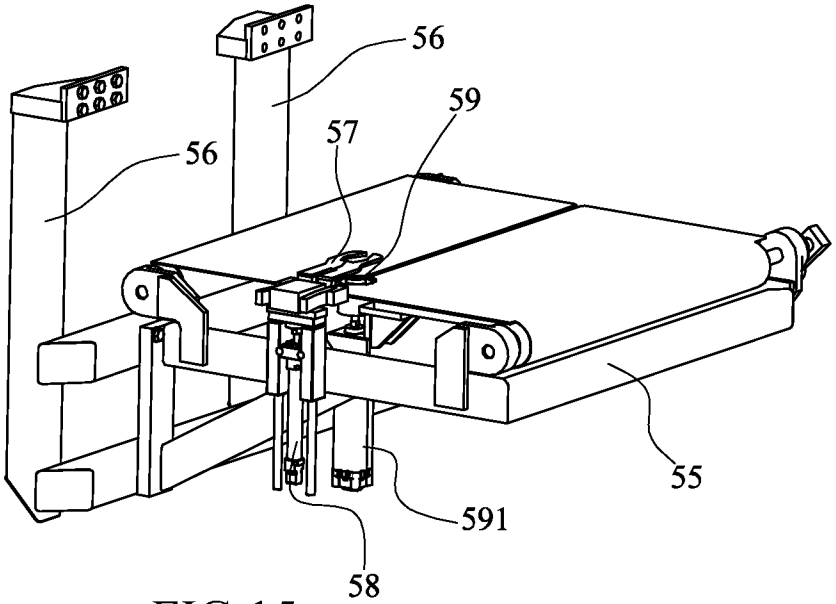

A pad 59 is located below the lower rest plane 51, which pad 59 is activated by the cylinder piston 591 to rise above the rest plane through an opening therein, (FIGS. 15, 16).

The pad 59 rises, after the bag has been filled, coming into contact with the mouth, such as to close and prevent the slightly pressurised air in the sterile chamber from entering the bag, inflating it before the removable cap is repositioned on the mouth.

For each lower rest plane 51, the rotating platform supports a filling group 6 (FIGS. 7-12) located projectingly with respect to the platform.

Each filling group 6 is supported by a bracket 7 which comprises a first vertical plate 71 provided with a pair of horizontally projecting shelves 72.

The shelves support the sterile chamber 74 in a height-adjustable position.

Figure 9:
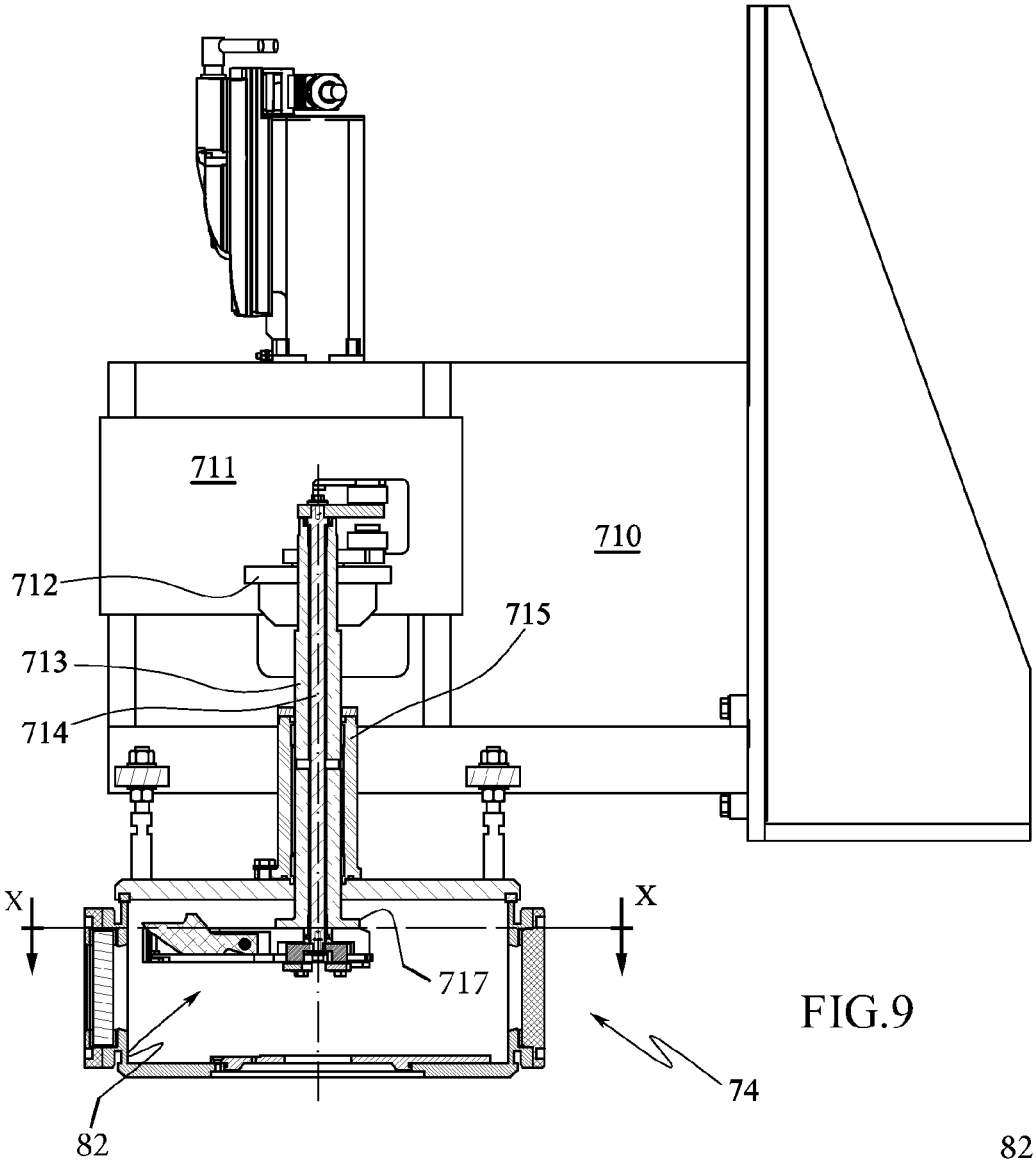
FIG. 9 shows the section along line IX-IX of FIG. 8.
Figure 10:
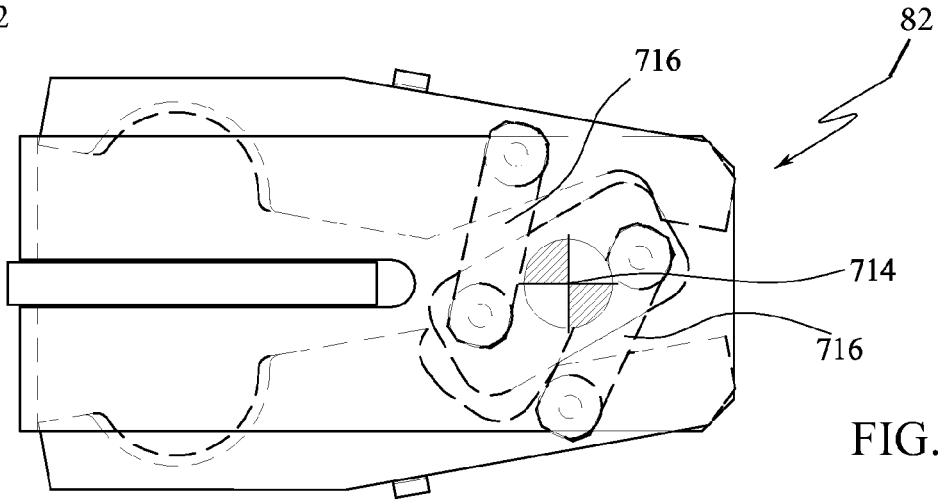
FIG. 10 shows the section along line X-X of FIG. 9.
Figure 12:
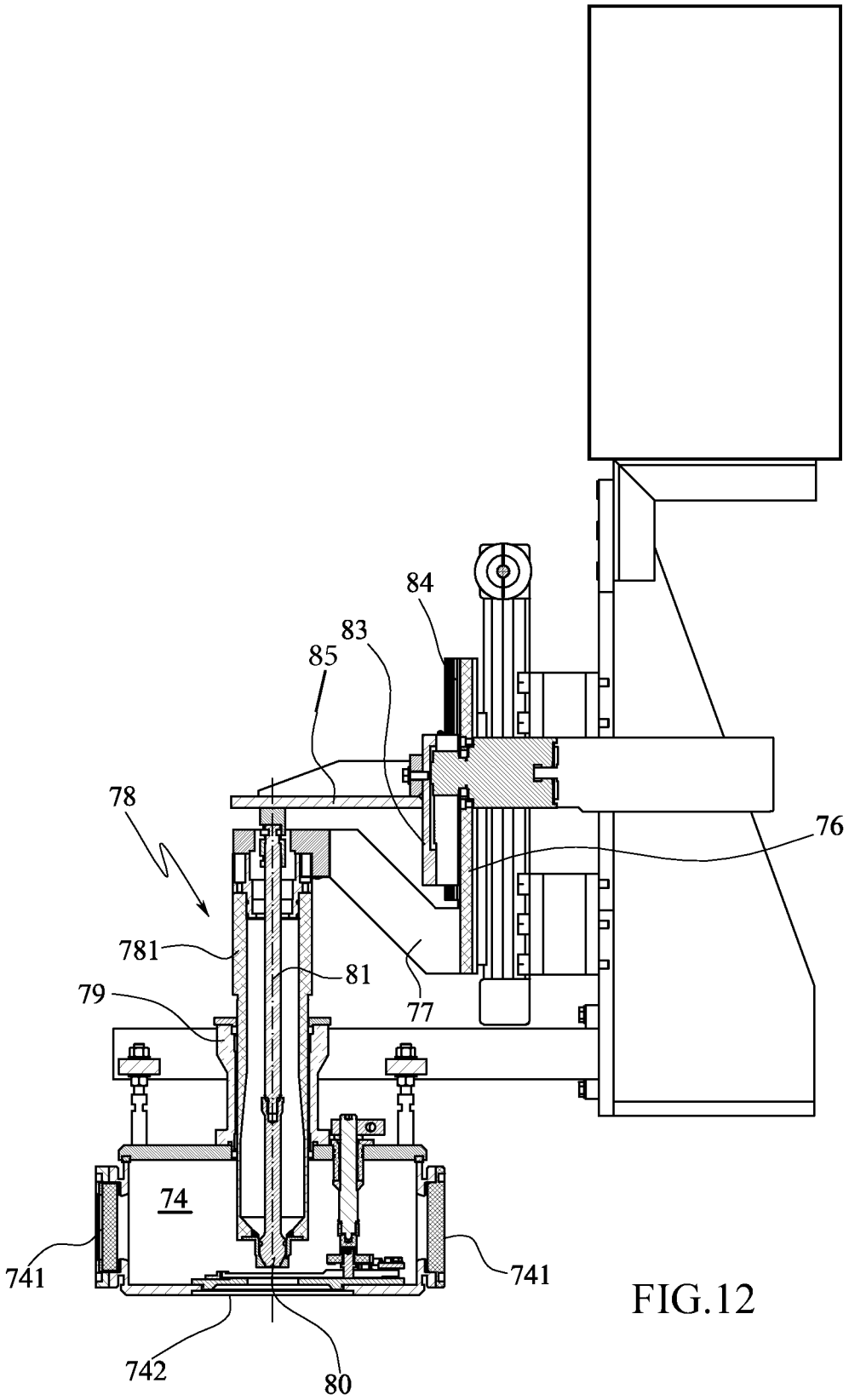
FIG. 12 illustrates section XII-XII of FIG. 11.

The chamber supports, on each side, an inspection hatch 741, as well as an opening 742 on the lower wall, via which the mouth enters with the respective movement organs (FIGS. 9, 12).

On the side facing towards the outside of the platform, the vertical plate 71 comprises a first pair of guides 75 (FIG. 7) on which a first plate 76 slides vertically, from which first plate 76 a first bracket 77 derives, which supports the end of the batching device 78 (FIGS. 11, 12) which supplies the liquid.

This device comprises (FIG. 12) a cylindrical body 781 that fits slidably into the sterile chamber 74 by means of a sealed coupling 79.

The lower end of the batching device 78 exhibits an axial hole which is closed by a shutter 80.

The shutter 80 is supported by a stem 81 superiorly protruding from the batcher, where it is supported by a shelf 85.

The shelf 85 is derived from a second plate 83, parallel to the first plate 76 and slidable on vertical guides 84 present on the first plate.

The sliding of the first plate 76 with respect to the guides 75 is performed by means not described in detail as they are of usual kind.

Similarly, the sliding of the second plate 83 with respect to the guides 84 is performed by means not described in detail as they are of usual kind.

Figure 11:
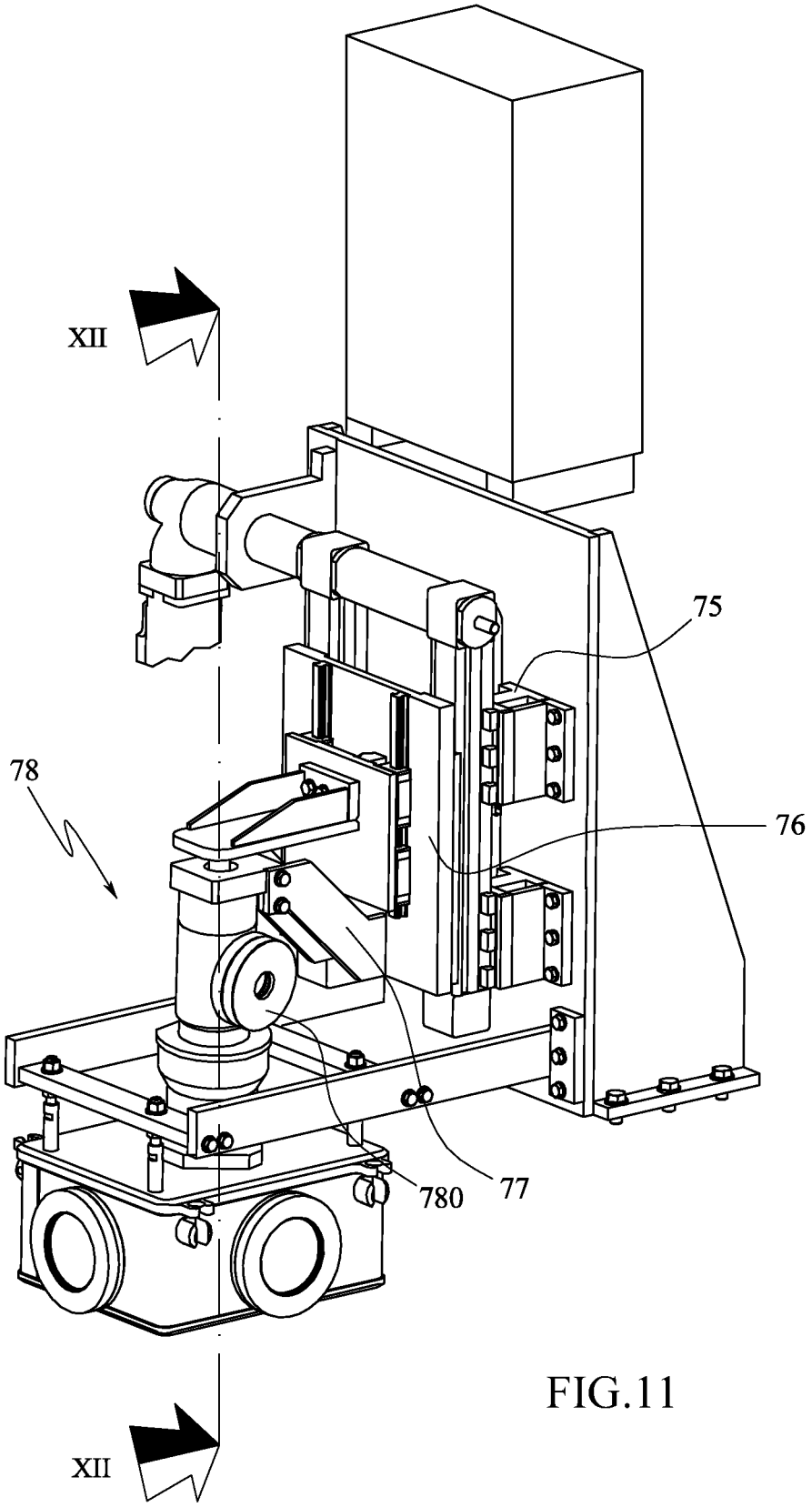
FIG. 11 is the view of FIG. 7 with some parts removed.

The batching device 78 comprises an inlet hole 780 FIG. 11 which is connected by a tube to a swivel joint distributor that receives the liquid from a suitable reservoir that serves all six special filling devices.

The joint and the reservoir are not illustrated, as they are of known kind.

The means for removing the cap from the mouth and displacing it sideways are located internally of the sterile chamber; once the filling has been completed, the means perform the reverse operation.

These means are illustrated in figures from 7 to 10.

The fixed plate 71 laterally and projectingly bears a radial vertical plate 710, on which a plate 711 activated in a known way by the motor 70 slides vertically.

The plate 711 comprises a horizontal shelf 712 which supports a tubular body 713 in which a shaft 714 is inserted.

The body 713 is inserted from above into the underlying sterile chamber 74 through a sealing and guiding sleeve 715, which is fixed to the upper wall of the sterile chamber 74.

A horizontal flange 717 is derived from the base of the tubular body 713, which functions as a support for the two jaws of the pliers 82 that are identical to the pliers 32.

At the base, the shaft 714 bears a plate to which two con rods 716 attach at heads thereof, which con rods 716 activate the jaws in response to the rotations of the shaft.

The tubular body 713 is subjected to rotations about the axis thereof, and to this end it comprises an upper crank 7130 which is connected by a con rod 7131 to a servomotor 7132 located behind the plate 710.

Similarly, the shaft 714 is subject to rotations about the axis thereof, and to this end comprises an upper crank 7140 that is connected by a con rod 7141 to a servomotor 7142 located behind the plate 710.

The carousel 4 is powered in continuous rotary motion and the empty bags are supplied in synchrony onto the lower rest planes 51

When a lower rest plane 51 has received the empty bag from the arm 31, the pliers 32 are opened and the bag is released onto the lower rest plane 51.

During rotation of the lower rest plane 51, the following activities take place.

The pliers 57 lift the filling mouth internally of the sterile chamber through the lower opening 742 therein.

In this position the cap removal device rotates by 90° and the pliers 82 are closed such as to grasp the cap.

This is accomplished by the coordinated action of the actuators 7132 and 7142.

Thanks to the upward displacement of the plate 711, the tubular body 713 and the shaft 714 are raised together, and so remove the cap from the mouth.

Subsequently, the tubular body 713 and the shaft 714 rotate in synchrony, still actuated by servomotors, and locate the pliers 82, with the gripped cap, by the side of the mouth.

When the plug has been removed and placed to the side the batching device 78 supported by the bracket 77 is lowered.

This occurs by the translation of the plate 76 in a downwards direction.

The batching device sealingly rests on the mouth, and thanks to the vertical translation of the plate 83 in relation to the plate 76, the shutter 80, suspended by the stem 81 from the shelf 85 that is solidly constrained to the plate 83, opens the lower hole of the batching device and enables the descent of the material into the bag which is filled.

When filling has completed, the pad 59 rises from the rest plane of the bag, and pushes the lower flap of the bag against the mouth, temporarily sealing the bag against undesired inlet into the mouth of any gases in overpressure that might be present in the sterile chamber.

During all the activities described in the sterile chamber has completed the up to close to the unloading position of the bag.

In this position the above-described devices are activated in an opposite direction, and when the filling station is in the unloading position, the pliers 57 lower and the rest plane 51 opens and releases the bag onto the belt, which removes the full bag.

It is understood, therefore, that this invention is not limited to the particular embodiments disclosed, but is intended to cover all modifications which are within the spirit and scope of the invention as defined by the appended claims; the above description; and/or shown in the attached drawings.

What is claimed is:

1. An aseptic filling machine for envelope-type bags having a filling mouth closed by a removable cap located on a side of the envelope, the filling machine comprising:

an empty bag supply device and a removal device to remove the bags when filled;

a carousel device equipped with a rotating platform having continuous motion on which at least two filling stations are located, said at least two filling stations being circumferentially equidistant, each filling station comprising a rest plane for the bag and a filling group;

a feeder and positioning device of the empty bag in a first filling station; and a discharging device of the filled bags from the filling station adjacent the first station, each filling group comprising:

a sterile chamber;

a raising device configured to raise the mouth of an empty bag lying on the rest plane internally of the sterile chamber;

an overpressure device configured to place the sterile chamber in slight overpressure;

a removal device configured to remove the cap from the filling mouth and position the cap by a side of the filling mouth, and vice versa, said removal device being placed internally of said sterile chamber; and a dispenser-batcher device that is vertically slidable into the sterile chamber and configured to engage with the filling mouth, wherein the removal device comprises a radial vertical plate that is solidly constrained to the carousel, on which a plate slides vertically, the plate comprising a horizontal shelf that rotatably supports a tubular body in which a coaxial shaft is inserted, a displacement mechanism being provided configured to vertically move the plate, the tubular body being inserted in the underlying sterile chamber, jaws of a first pair of pliers being hinged between the ends of the tubular body and the shaft, and a device being provided configured to rotate, in a coordinated and independent way, the tubular body and the shaft about the axis such as to open and close the first pair of pliers and rotate the tubular body and the shaft by at least 90°.

2. The machine of claim 1, wherein the feeder and positioning device of the bag comprises a second pair of pliers located at an end of a horizontal lever that move between a position in which the second pair of pliers overlie the mouth of a bag exiting from a supply line, and a second position in which the second pair of pliers position the mouth in a correct position on the rest plane of the station.

3. The machine of claim 2, wherein the second pair of pliers comprise two jaws which are arranged spread by 180° when the second pair of pliers are open.

4. The machine of claim 1, further comprising a pad arranged below the rest plane which is activated by a piston-cylinder group such as to rise above the rest plane via an opening therein, coming into contact with the mouth, such as to close the mouth by pushing against the lower side of the bag in order to prevent the slightly pressurised air from the sterile chamber from entering the bag and inflating it before the removable cap is repositioned on the mouth.

5. The machine of claim 1, wherein each filling station comprises a lower rest plane for the bag, comprised of two doors which can be arranged coplanarly and can rotate symmetrically in a downward direction in order to release the bag such that the bag drops.

6. The machine of claim 5, wherein each door is coupled to a roller on an axis of which a crank is keyed, said crank is headed at a stem of a single piston-cylinder group which impresses a symmetrical motion on the doors.

7. The machine of claim 1, wherein the raising device comprises a third pair of pliers that is vertically mobile by action of a piston-cylinder group located by a side of, and supported by, the rest plane.

8. The machine of claim 1, wherein the dispenser-batcher device comprises a cylindrical body that is vertically slidable and inserts into the sterile chamber via a sealed joint, the lower end of the batcher exhibiting an axial hole which is closed by a shutter coaxial with the cylindrical body.

9. The machine of claim 8, wherein the cylindrical body is supported by a bracket headed at a first plate that is vertically mobile with respect to the carousel.

10. The machine of claim 9, wherein the shutter is supported by a shelf at a second plate that is vertically mobile with respect to the first plate.

11. The machine of claim 1, wherein the rest plane of the bag is comprised of two doors that can be arranged coplanarly or can rotate symmetrically downwards, each door being coupled to a roller on the axis of which a crank is keyed, said crank is headed at the stem of a single piston-cylinder group.

12. The machine of claim 1, further comprising a base attached to a lower end of the tubular body, wherein the base supports the first pair of pliers.

13. The machine of claim 1, further comprising:

a plate attached to a lower end of the coaxial shaft; and a pair of rods, each rod having a first end attached to the plate and a second end attached to one of the first pair of pliers, wherein the pair of rods operate the first pair of pliers in response to rotation of the coaxial shaft.

* * * * *